United States Patent [19]

Newquist et al.

[11] 4,119,247

[45] Oct. 10, 1978

[54] GARMENT-SUPPORTABLE TENNIS BALL POCKET

[76] Inventors: Barbara Lee Newquist, One Artillery La., Scarsdale, N.Y. 10583; Scott C. Newquist, 155 E. 88th St., New York, N.Y. 10028

[21] Appl. No.: 791,868

[22] Filed: Apr. 28, 1977

[51] Int. Cl.[2] ..... A45F 5/00; A63B 61/00

[52] U.S. Cl. ..... 224/5 D; 211/14; D2/400

[58] Field of Search ..... 224/5 D, 45 L, 5 R, 224/2 B, 2 C, 2 D, 5 A, 5 B, 26 R, 26 B, 26 K, 28 R, 28 B; 211/14; D2/400, 452, 25

[56] References Cited

U.S. PATENT DOCUMENTS

| | | | |
|---|---|---|---|
| D. 238,628 | 2/1976 | Davis | D2/400 |
| 2,304,235 | 12/1942 | Boots | 224/5 D |
| 2,926,912 | 3/1960 | Gould | 224/5 D |
| 3,865,290 | 2/1975 | Sperling | 224/5 D |
| 3,873,009 | 3/1975 | Goudreau | 224/5 D |

*Primary Examiner*—Trygve M. Blix
*Assistant Examiner*—Jerold M. Forsberg
*Attorney, Agent, or Firm*—Watson, Leavenworth, Kelton & Taggart

[57] ABSTRACT

Garment-supportable tennis ball pocket including an ovally-open circumambient and lateral rim of relatively stiff, flexible material, e.g., plastic, having elastic recovery memory and with a pair of generally opposite sections thereof forming non-circular bights with opposed sides of each such bight positioned more closely toward each other than the sides of the opposed pair of intervening sections and with the latter defining arcs of appreciably lesser curvature. This pocket also includes a plurality of elongated and flexible members of similar plastic depending down from its rim at annularly spaced areas and converging appreciably therebelow to a bottom common connection whereby they define together a ball-holding pocket with lateral openings between these depending members being too small for such ball to exit therethrough, and with the rim retaining its ovally-open shape when a tennis ball is in the pocket whereby exit of the ball out through the rim opening is prevented until the latter is reshaped to a substantially circular form by application of suitable internal and/or external forces. Fastening equipment is used to attach this ball pocket to a person's clothing.

9 Claims, 10 Drawing Figures

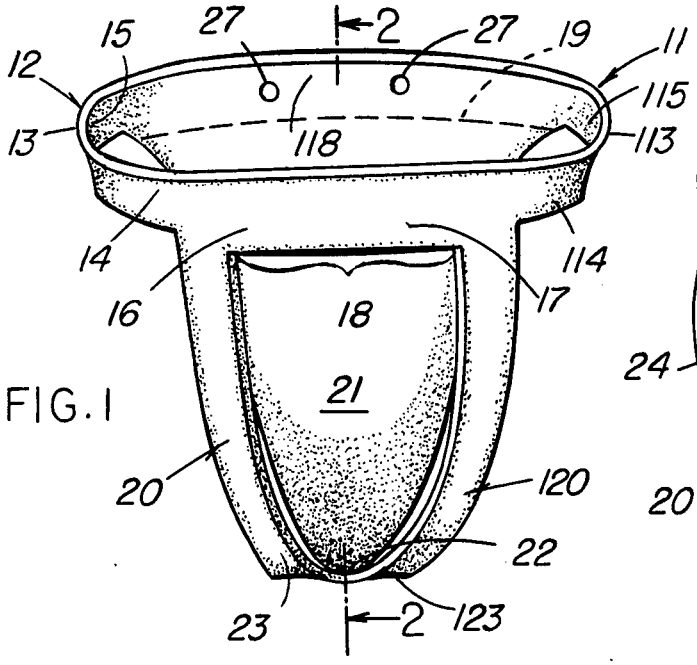
FIG. 1
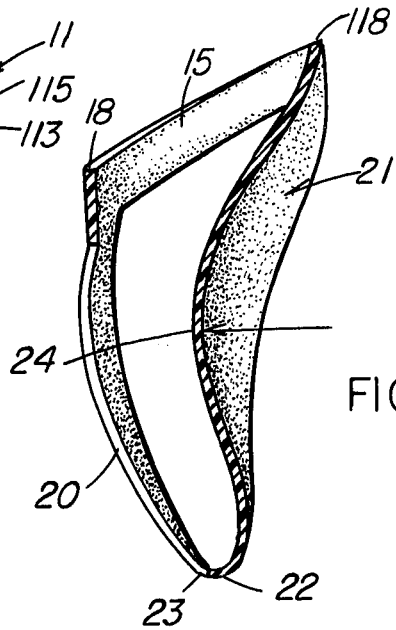
FIG. 2
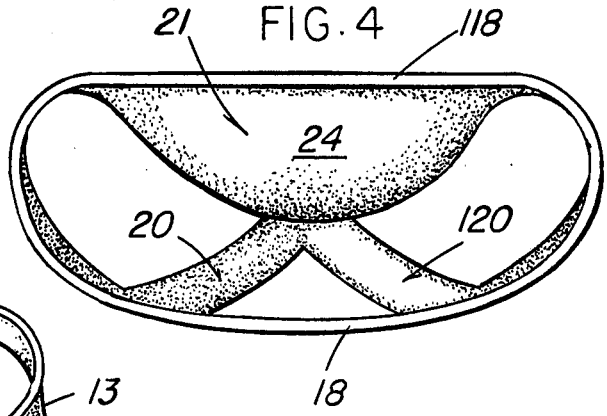
FIG. 4
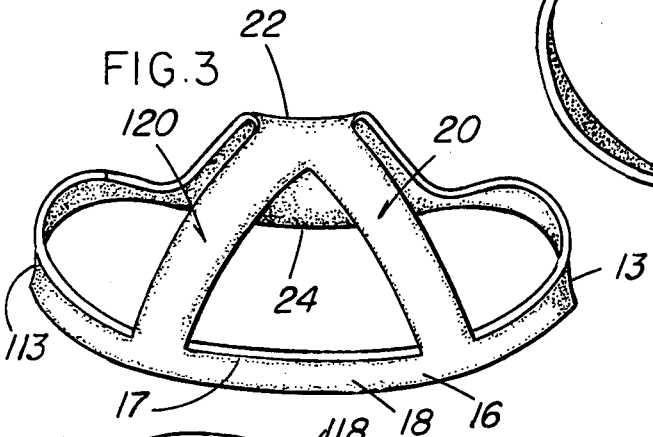
FIG. 3
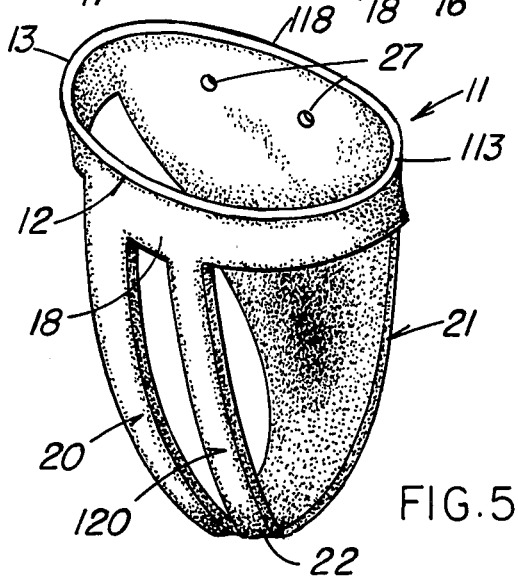
FIG. 5
FIG. 6
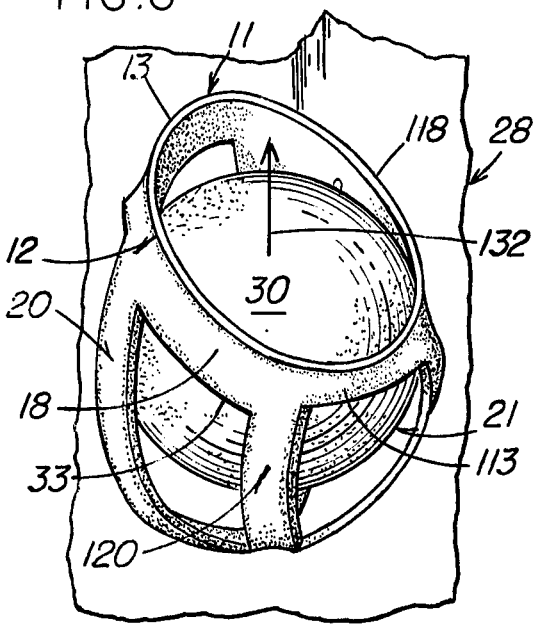

FIG. 9
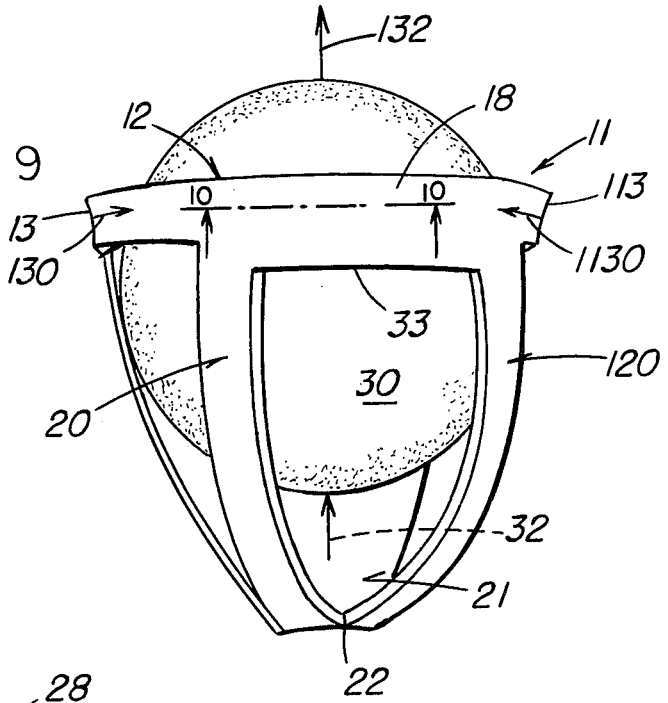
FIG. 10
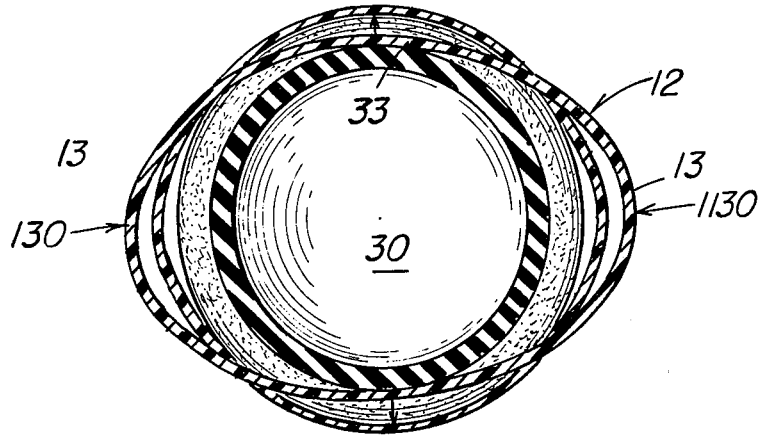
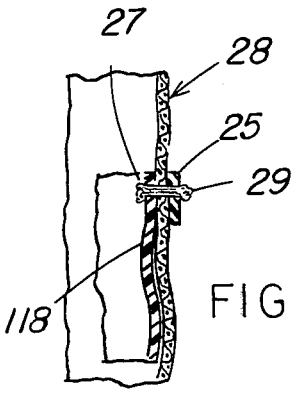
FIG. 7
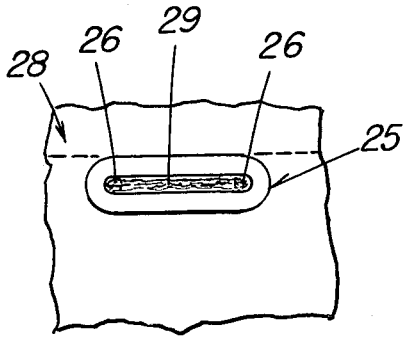
FIG. 8

GARMENT-SUPPORTABLE TENNIS BALL POCKET

BACKGROUND AND SUMMARY

The present invention relates to garmet-supportable tennis ball pockets which may be used after mount upon player's garments, such as in an area of one hip of and behind any such player, for support in each of a readily available spare tennis ball while avoiding to some degree interference with such player's motions during game progress. No such prior art devices which have any particular pertinency to the present invention are known to the present applicants.

The present invention provides a garment-supportable tennis ball pocket that includes an ovally-open circumambient and lateral rim of relatively stiff, flexible material, e.g., plastic, having elastic recovery memory and with a pair of generally opposite sections thereof forming non-circular bights with opposed sides of each such bight positioned more closely toward each other than the sides of the opposed pair of intervening sections and with the latter defining arcs of appreciably lesser curvature. This pocket also has a plurality of elongated and flexible members of similar plastic depending down from its rim at annularly spaced areas and converging appreciably therebelow to a bottom common connection whereby they define together a ball-holding pocket below the rim with lateral openings between these depending members being too small for such ball to exit therethrough, and with the rim retaining its ovally-open shape when a tennis ball is in the pocket whereby exit of the ball out through the rim is prevented until the latter is reshaped to a substantially circular form by application of suitable internal and/or external forces. There is also provided simple and practical means to fasten this pocket to the exterior of a person's clothing, e.g., at a convenient place on a hip area thereof. Plastic may be preferred to various types of fabric for the material from which to form such a ball pocket, since relatively smooth plastic has greater slippage relative to the usual shaggy surface of standard tennis balls.

The ball pocket may be conveniently provided with a pair of the depending members at one rim side section between the pair of opposed bight end rim sections, which preferably may be in the form of elongated, flexible straps, and the opposed side rim section advantageously may have depending therefrom a relatively wide cup-shaped panel having a relatively narrow tab bottom connected to the bottom ends of the straps. This panel conveniently may be triangular and its cupping may be substantially centrally located and facing inward to define with the other parts the open ball-receiving pocket. Such cupping can be molded in this panel to be transversely reversible over dead center by application of lateral force transversely inward against the outside bulge caused by the inside cupping so that the cupping thus is transferred to this panel outer side. Such reshaping by this outside application of lateral pressure beyond dead center conveniently flattens the pocket for conservation of space occupied by the pocket, e.g., in the shipping, storing and handling thereof, as well as in the wearing thereof.

An embodiment of the present invention is illustrated in the copending Design patent application Ser. No. 777,518, filed Mar. 14, 1977.

It is a general object of the present invention to provide such a tennis ball pocket which is readily and economically produced in mass production in a practical and relatively simple manner, such as by being formed or molded in one piece from suitable elastic material, e.g., a suitable plastic, which conveniently may be low density polyethylene, and which is easily attached to a player's garment at a convenient place for there securely carrying a tennis ball while permitting easy withdrawal of the latter when needed, e.g., such as the second ball of a service.

Other objects of the invention will in part be obvious and will in part appear from reference to the following detailed description taken in connection with the accompanying drawings, wherein like numerals identify similar parts throughout, and in which:

FIG. 1 is a front elevational view of an embodiment of the garment pocket of the present invention with the triangular back side thereof being, by way of example, concave on its inner side by the molding of this pocket to have its ball-receiving shape;

FIG. 2 is an elevational section taken along a vertical line substantially coincident with line 2—2 of FIG. 1, but with its triangular back side panel distorted to convexity on its inner side for partial collapse of this pocket to attain spaceoccupying conservation;

FIG. 3 is a bottom perspective view of the partially collapsed pocket of FIG. 2 and as viewed obliquely from a point forward of and beneath its bottom portion;

FIG. 4 is a top plan view of the partially collapsed pocket of FIGS. 2 and 3;

FIG. 5 is an elevational perspective view of the pocket of FIG. 1 with the triangular back panel thereof convexed outwardly to expand it to its ball-receiving condition;

FIG. 6 is an elevational view of a portion of a person's costume and particularly that below the waistline, to which has been anchored such embodiment of the tennis ball pocket with it loaded with such a tennis ball from which the ball may be readily removed up through the open oval rim of the pocket by thrust upward thereagainst of a portion of the wearer's hand, or a finger or thumb;

FIG. 7 is a detailed sectional view of a portion of the person's fabric garment shown in FIG. 6 and the anchorage employed therein for the securement of the pocket to that fabric portion;

FIG. 8 is a back elevational view of the portion of the garment fabric shown in FIG. 7 and showing a face view of a preferred form of the pocket anchorage structure;

FIG. 9 is an elevational view to enlarged scale of the ball and pocket assembly of FIG. 6 illustrating ready removal of the ball from the cupped pocket; and FIG. 10 is a transverse sectional view taken substantially on line 10—10 of the ball and pocket assembly shown in FIG. 9.

As will be seen from FIG. 1 a preferred embodiment of the garment-supportable tennis ball pocket 11 of the present invention comprises an ovally-open, circumambient and lateral rim 12 of relatively stiff, flexible material, e.g., plastic, that has the desired elastic recovery memory. This rim 12 has a pair of generally opposite sections forming loop bights 13 and 113 with opposed sides of each such bight, e.g., of bight 13, with its opposed sides 14 and 15 positioned more closely toward each other than the sides 16 and 17 of either the intervening side 18 or the opposite side 118 which is a lateral zone defined above the zone margin broken line 119. These opposed pair of intervening sections 18 and 118 which are flanked on opposite sides by the bights 13 and 113 and the respective sides 14 and 15 and 114 and 115 of the latter, as shown in FIG. 1, define arcs of appreciably lesser curvature than these bights to assure the definition therebehind of the desired ovally-open circumambient lateral rim.

From this rim depends a plurality of elongated and flexible members of suitable or similar material, such as like or similar plastic, which extend downwardly therefrom at annularly spaced areas. In the preferred form this plurality of elongated, flexible members includes a pair of such depending members in the form of straps 20 and 120 which depend from the vicinities of the ends of the intervening rim section 18 that may be considered the front side of such pocket. An additional elongated, flexible, depending member in the form of a relatively wide cup-shaped panel 21 depends from the intervening rim section 118 at the transverse zone line 119 and this panel terminates at the bottom in a relatively narrow tab 22 which may be integrally formed with the bottom ends 23 and 123 of the depending straps 20 and 121. This pocket structure may be molded as an integral unit from a suitable elastic plastic.

It will be seen from FIGS. 2, 3, and 4 that the triangular back panel 21 may then be laterally inwardly cupped or bowed to provide a central bulge 24 which has so stressed the rim zone 118 as to cause it to appear to be substantially straight along its lateral edge (FIG. 4).

As in FIG. 1, FIG. 5 indicates that the lateral circumambient rim 12 is ovally-open when the inwardly concaved triangular back section 21 is inverted rearwardly over dead center to reverse the cupping thereof outwardly so that laterally the pocket 11 in its upright position has the overall appearance of being transversely oval in substantially all transverse planes down to near the bottom tip end 22. It is this pocket condition which is its ball carrying posture illustrated in FIG. 6.

FIG. 6 illustrates that the ovally-open circumambient lateral rim 12 is conveniently attachable by any suitable means to any selected exterior portion of a person's clothing, e.g., in the convenient locale of one hip area. If desired, this pocket may, in its attached position, be located partly behind the player's body as to avoid interference with racquet strokes, but readily available for withdrawal therefrom of a tennis ball nesting therein. It will be seen from FIGS. 6, 7, and 8 that such an anchorage may consist of a relatively stiff tab 25 having a pair of holes 26,26 at opposite ends which preferably may be laterally spaced apart about the same distance as are holes 27,27 formed in the upper lateral zone of the triangular depending panel 21 (FIGS. 1, 5, and 7). The anchorage means may conveniently be loops of thread sewed through the tab holes 26, the fabric 28, and the pocket holes 27 successively. Such thread loops are indicated at 29 in FIGS. 6, 7, and 8.

It will be understood from FIG. 6 that when it is desired to remove a tennis ball 30 nested in pocket 11 the latter conveniently may be accomplished in the following or a similar manner. The ball may be moved up through the ovally-open circumambient rim 12 either by putting one's finger or fingers through one or more of the spaces intervening the straps 20 and 120 and/or one of these straps and the triangular panel 21 to push upward against the bottom hemispherical ball section that is nested deepest in the pocket, such as in the direction of the arrows 32 and 132 in FIG. 9, for forcing the leading or top hemispherical ball section up through the oval rim 12 to swell it to a shape approaching circularity, or at least a wider oval, in which the shortest dimension thereacross is substantially equal to the external diameter of the ball. Some may prefer a removal operation that may include squeezing pressure applied to the bights 13 and 113 as indicated by the arrows 130 and 1130 shown therein. It will be seen from FIG. 10 that the initial oval shaping of the rim 12 causes the leading hemispherical sector of the ball to catch against the transverse inner edge 33 of the lateral rim sector 18 for preventing the ball from falling out, and it is also illustrated in FIG. 10 that pressure forward on the ball from therebehind causes the rim bights 13 and 113 to move their central portions inward in the direction of the arrows 130 and 1130 so that the rim swells out transversely to a shape approaching circularity, which facilitates removal passage of the ball therethrough.

It will thus be understood from the preceding disclosure, and particularly FIGS. 9 and 10, that the ovally-open, lateral and circumambient rim 12 of relatively stiff, flexible material has transverse elastic recovery memory while being substantially inelastic longitudinally. A pair of the generally opposite sections of this rim form non-circular bights 13 and 113 with the opposed sides of each such bight being positioned more closely toward each other than the sides of the intervening sections 18 and 118 and with the latter defining arcs of appreciably lesser curvature. This four-section circumambient rim 12 is of an annular dimension which permits a tennis ball to slip easily therethrough when this oval surrounding or encompassing rim is forced into a substantially circular shape, as is precedingly described and illustrated in the drawings, particularly FIGS. 1, 9 and 10.

Attention is called to the fact that in order for the opposed bights 13 and 113, or the opposite sections of the rim 12 which provide them, to be more flexible than intervening rim sections 18 and 118, these bight sections merely may be narrower than the front rim section 18. For example, the front rim section may be about $\frac{1}{2}$ an inch wide vertically, and the bight sections about $\frac{3}{8}$ of an inch wide. This feature alternately may be embodied by using thinner end bight sections than are the front and back sections thereof, or by other suitable means which will readily occur to one. When such a pocket is designed for the nesting therein and carrying thereby of a tennis ball, which may have a diameter of about $2\frac{5}{8}$ inches, the pocket will be of a depth from its bottom up to the lower edge of the rim section 18 appreciably greater than the radius of such a ball, so that the transverse medial zone of the latter will catch beneath this pocket transverse section bottom edge with the oval shaping of the top lateral rim. It is this latter feature which chiefly prevents the ball from jouncing out of the pocket during the active running, quick stopping, dodging, etc., motions of the player during game progress.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is the novel subjects matter defined in the following claims:

1. A garment-supportable tennis ball pocket comprising (1) an ovally-open circumambient and lateral rim of relatively stiff, flexible material having transverse elastic recovery memory while being substantially inelastic longitudinally and with a pair of generally opposite sections thereof forming non-circular bights with opposed sides of each such bight positioned more closely toward each other than the sides of the opposed pair of intervening sections and with the latter defining arcs of appreciably lesser curvature, said circumambient rim being of an annular dimension which permits a tennis ball to slip therethrough when this rim is forced into a substantially circular shape;

(2) a plurality of elongated and flexible members depending down from said circumambient rim at annularly spaced areas and converging appreciably below this rim to a bottom common connection whereby they define together a ball-holding pocket below the rim with lateral openings between said members being too small for such ball to exit therethrough, and with the rim retaining its ovally-open shape when a tennis ball is in the pocket whereby exit of the ball out through the rim is prevented until the latter is reshaped to a substantially circular form by applying suitable lateral forces; and (3) means to fasten said pocket to an exterior of a person's clothing.

2. The ball pocket as defined in claim 1 characterized by a laterally spaced pair of said plurality of elongated, flexible, depending members being in the form of straps depending from the vicinities of the ends of one of said intervening rim sections.

3. The ball pocket as defined in claim 1 characterized by one of said elongated, flexible, depending members being in the form of a relatively wide cup-shaped panel depending from one of said intervening rim sections.

4. A garment-supportable tennis ball pocket comprising (1) an ovally-open circumambient and lateral rim of relatively stiff, flexible material having elastic recovery memory and with a pair of generally opposite sections thereof forming non-circular bights with opposed sides of each such bight positioned more closely toward each other than the sides of the opposed pair of intervening sections and with the latter defining arcs of appreciably lesser curvature;

(2) a plurality of elongated and flexible members depending down from said rim at annularly spaced areas and converging appreciably below this rim to a bottom common connection whereby they define together a ball-holding pocket below the rim with lateral openings between said members being too small for such ball to exit therethrough, and with the rim retaining its ovally-open shape when a tennis ball is in the pocket whereby exit of the ball out through the rim is prevented until the latter is reshaped to a substantially circular form by applying suitable lateral forces; and (3) means to fasten said pocket to an exterior of a person's clothing; a laterally spaced pair of said plurality of elongated, flexible, depending members being in the form of straps depending from the vicinities of the ends of one of said intervening rim sections; the remaining one of the pair of intervening rim sections being in the form of a lateral top zone of a relatively wide cup-shaped panel having a relatively narrow tab bottom connected to the bottom ends of said depending straps.

5. A garment-supportable tennis ball pocket comprising (1) an ovally-open circumambient and lateral rim of relatively stiff, flexible material having elastic recovery memory and with a pair of generally opposite sections thereof forming non-circular bights with opposed sides of each such bight positioned more closely toward each other than the sides of the opposed pair of intervening sections and with the latter defining arcs of appreciably lesser curvature;

(2) a plurality of elongated and flexible members depending down from said rim at annularly spaced areas and converging appreciably below this rim to a bottom common connection whereby they define together a ball-holding pocket below the rim with lateral openings between said members being too small for such ball to exit therethrough, and with the rim retaining its ovally-open shape when a tennis ball is in the pocket whereby exit of the ball out through the rim is prevented until the latter is reshaped to a substantially circular form by applying suitable lateral forces; and (3) means to fasten said pocket to an exterior of a person's clothing; one of said elongated, flexible, depending members being in the form of a relatively wide cup-shaped panel depending from one of said intervening rim sections; said cup-shaped panel being substantially triangular with its narrow bottom end being of tab formation and connected to the bottom ends of the others of said depending members.

6. The ball pocket as defined in claim 5 characterized by all of the recited parts of said pocket being integrally molded in the form of relatively thick sheet plastic.

7. The ball pocket as defined in claim 6 characterized by said cup-shaped triangular panel being molded with its cupped side facing inward whereby this pocket has an overall appearance of being transversely oval in substantially all transverse planes down to near the bottom tip end.

8. The ball pocket as defined in claim 7 characterized by said inwardly cupped triangular panel having the cupped portion thereof pressed laterally inward with flexure of its cupped portion inward over dead center to reversal of cupping whereby its cupped side retentively faces outward temporarily with appreciable space-conserving flattening of the entire pocket structure.

9. The ball pocket as defined in claim 7 characterized by the lateral section of said oval rim which on one side intervenes said non-circular bight sections with the lateral top zone of said opposite triangular panel being of greater cross-sectional areas whereby they are stiffer than said bight sections to assure retention of the oval shape of the rim except when the latter are forced laterally inwardly toward each other or a ball is forced down into or up out of the pocket through said oval rim, and recovery of this oval shape when such reshaping forces are terminated.

* * * * *